US007249753B2

(12) United States Patent
Glatz

(10) Patent No.: US 7,249,753 B2
(45) Date of Patent: Jul. 31, 2007

(54) WINCH, PARTICULARLY FOR DRIVING AN UMBRELLA

(76) Inventor: Gustav Adolf Glatz, Talacherstrasse 55, CH-8500 Frauenfeld (CH)

( * ) Notice: Subject to any disclaimer, the term of this patent is extended or adjusted under 35 U.S.C. 154(b) by 220 days.

(21) Appl. No.: 10/523,731

(22) PCT Filed: Jun. 25, 2003

(86) PCT No.: PCT/CH03/00417

§ 371 (c)(1),
(2), (4) Date: Jan. 31, 2005

(87) PCT Pub. No.: WO2004/014175

PCT Pub. Date: Feb. 19, 2004

(65) Prior Publication Data

US 2005/0229957 A1 Oct. 20, 2005

(30) Foreign Application Priority Data

Aug. 7, 2002 (CH) ..... 1368/02

(51) Int. Cl.
*B66D 1/48* (2006.01)

(52) U.S. Cl. ..... 254/271; 135/20.3

(58) Field of Classification Search ..... 254/270, 254/271, 272; 135/15.1, 20.3, 21
See application file for complete search history.

(56) References Cited

U.S. PATENT DOCUMENTS

| | | | | | |
|---|---|---|---|---|---|
| 837,960 | A | * | 12/1906 | Power et al. | 254/272 |
| 2,462,972 | A | * | 3/1949 | Johnson | 254/272 |
| 2,502,710 | A | * | 4/1950 | Duncan | 254/271 |
| 2,683,020 | A | * | 7/1954 | Johnson | 254/271 |
| 3,120,238 | A | | 2/1964 | Glatz | |
| 3,208,729 | A | * | 9/1965 | Townsen | 200/61.15 |
| 3,994,476 | A | * | 11/1976 | van Gennep | 254/272 |
| 4,054,188 | A | * | 10/1977 | Pannell | 188/65.3 |
| 4,236,694 | A | * | 12/1980 | Kristensson | 254/365 |
| 4,674,523 | A | | 6/1987 | Glatz | |
| 5,186,283 | A | * | 2/1993 | Salmon | 187/254 |
| 5,711,333 | A | | 1/1998 | Vanderminden, Sr. | |
| 5,845,665 | A | * | 12/1998 | Koehn | 135/98 |
| 5,988,596 | A | * | 11/1999 | Mitchell et al. | 254/271 |
| 6,014,980 | A | | 1/2000 | Glatz | |
| 6,196,242 | B1 | | 3/2001 | Xu | |
| 6,575,182 | B2 | * | 6/2003 | Tung | 135/20.1 |
| 2003/0010366 | A1 | | 1/2003 | Glatz | |

(Continued)

FOREIGN PATENT DOCUMENTS

| | | | |
|---|---|---|---|
| CH | 367 290 | A | 3/1963 |

(Continued)

*Primary Examiner*—Emmanuel M Marcelo
(74) *Attorney, Agent, or Firm*—George Pappas

(57) ABSTRACT

Disclosed is a winch, particularly for driving an umbrella, comprising a rope drum (48*a*) which is driven by a hand crank (24) and winds up a rope (28). Functioning of the winch is improved by the fact that said winch is provided with a feeler (100) which responds to the direction of entry of the rope when the rope (28) is fully unwound or to the winding of the rope onto the rope drum (48*a*). Said feeler (100) is connected to a locking member (102) that cooperates with a stop (104) if winding occurs in the wrong direction, said stop (104) being assigned to the rope drum (48*a*) and locking the wrong winding direction.

23 Claims, 7 Drawing Sheets

U.S. PATENT DOCUMENTS

2003/0015230 A1 1/2003 Glatz

FOREIGN PATENT DOCUMENTS

CH 666 166 A5 7/1988
EP 1 279 350 A1 1/2003
WO WO 97/04682 7/1996
WO WO 01/52686 A1 12/2000

* cited by examiner

WINCH, PARTICULARLY FOR DRIVING AN UMBRELLA

This application claims priority of PCT application PCT/CH2003/000417 having a priority date of Aug. 7, 2002 the disclosure of which is hereby incorporated herein by reference.

FIELD OF THE INVENTION

The invention concerns a winch, particularly for driving an umbrella.

BACKGROUND OF THE INVENTION

There are many types of winches. In the case of a fully unwound rope, this rope can be rewound onto a rope drum in one or the other direction. In specific cases, however, it may be necessary that the rope should be wound onto the rope drum only in one specific direction. A ratchet with pawls, which lock the winding of the rope in one direction is provided in known winches. For the purpose of unwinding the rope in known winches, the pawl is disconnected so that it is initially not active at the time of rewinding and has to be reconnected first. If the operator forgets to reconnect it, the winding of the rope can occur in the opposite direction.

In European Patent application No. 02011893 is proposed a winch in which a click-stop device is combined with a releasable click-stop device, which can be operated by a manual crank of the winch. A prerequisite for a correct functioning is, however, that the click-stop device cannot be released manually, but that the switchover from the click-stop device to the brake device and vice versa is determined by the rotational direction of the manual crank. It is also a prerequisite that the rope be wound onto the rope drum in the correct direction, which however is not automatically guaranteed.

SUMMARY OF THE INVENTION

It is the object of the invention to design a winch in such a way that a wrong winding direction of the rope on the rope drum is automatically prevented.

By providing the winch with a feeler, which responds to the direction of entry of the rope when the rope is unwound or the rope is wound on the rope drum, and which is connected to a stop that coacts with a stop assigned to the rope drum, which locks the rope drum if winding occurs in the wrong direction, it is automatically ensured that the rope is always wound in the correct direction.

The feeler can be prestressed in the locking position. Also possible is a configuration in which the feeler is prestressed when it is released. In principle, it is possible for the feeler to be active only at certain locations on the rope drum, but even more advantageous is an embodiment according to which the feeler is fixed and is arranged over the entire length of the rope drum.

Particularly preferred is an embodiment according to which the feeler is arranged on both sides on an arm of a two-armed rocker, respectively, which can be pivotably arranged around an axis, which is arranged parallel to the axis of the rope drum and at a radial distance thereto. The locking member is then provided on the other arm of the rocker. This winch responds to the direction of entry of the rope. For this purpose, it is useful if the pivot pin of the rocker is designed as a guide rod extending across the rope drum, which conveys the rope with a certain degree of guidance and improves the response of the feeler.

Also described herein is an alternative embodiment of the feeler, wherein the latter is configured as a slide that is prestressed in the direction of the surface of the rope drum and on which the locking member is arranged. The locking member runs against the stop when the rope drum rotates in the wrong direction. If direction of rotation is correct, the feeler responds to the winding of the rope and lifts the locking member out of the locking range of the stop.

Particular advantages of the winch result especially if the winch is equipped with a releasable click-stop device and a releasable brake device, which can be intercombined and actuated by the manual crank.

BRIEF DESCRIPTION OF THE DRAWINGS

Exemplary embodiments of the invention are described in more detail in the following based on the drawings, wherein.

PREFERRED EMBODIMENTS OF THE INVENTION

Figures 1, 2:
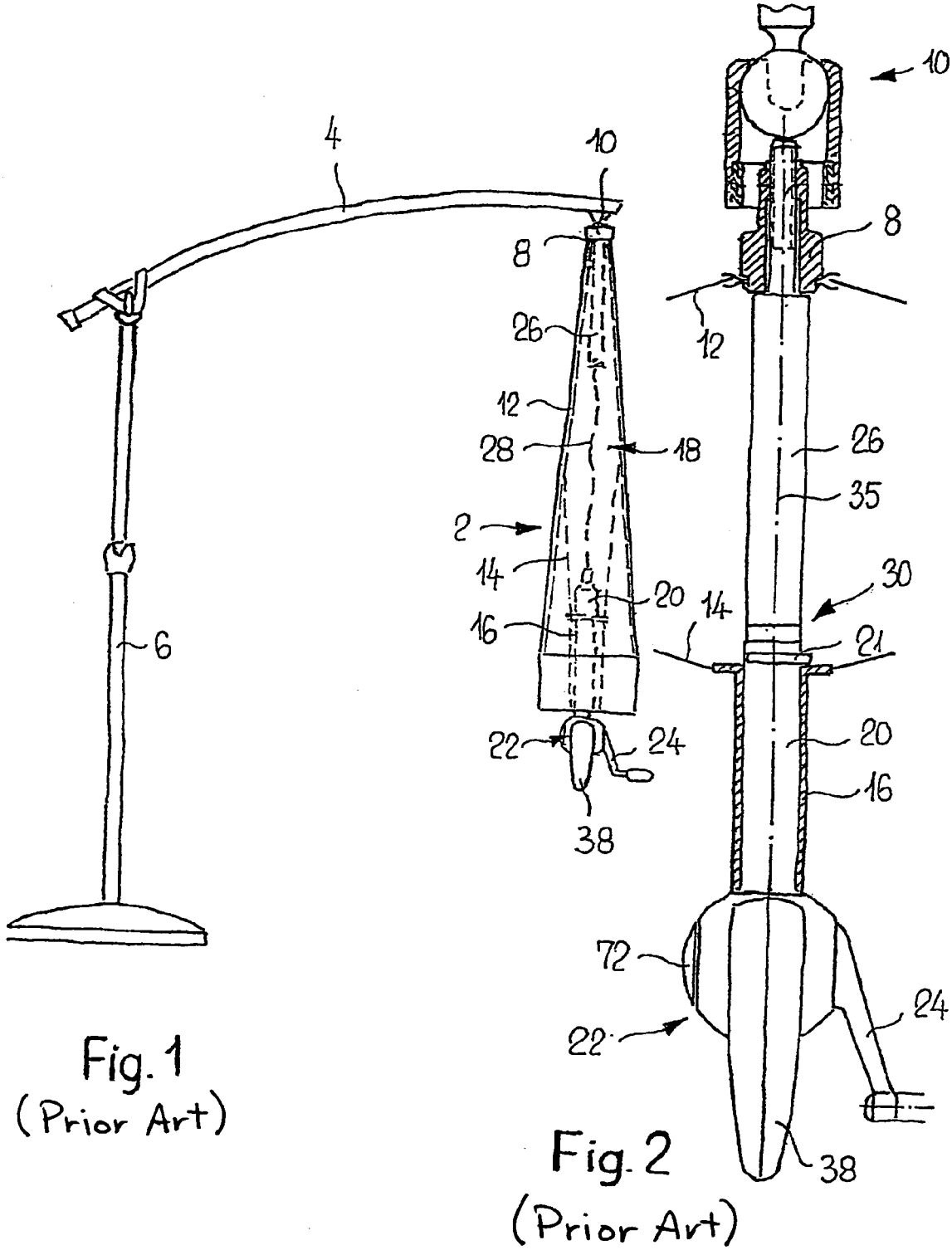
Fig. 1 (Prior Art)
Fig. 2 (Prior Art)
FIG. 1 shows an umbrella in closed status attached to an extension arm having a known winch as drive.
FIG. 2 shows an enlarged lateral view of the umbrella pole used in FIG. 1 with an open umbrella.
Figure 3:
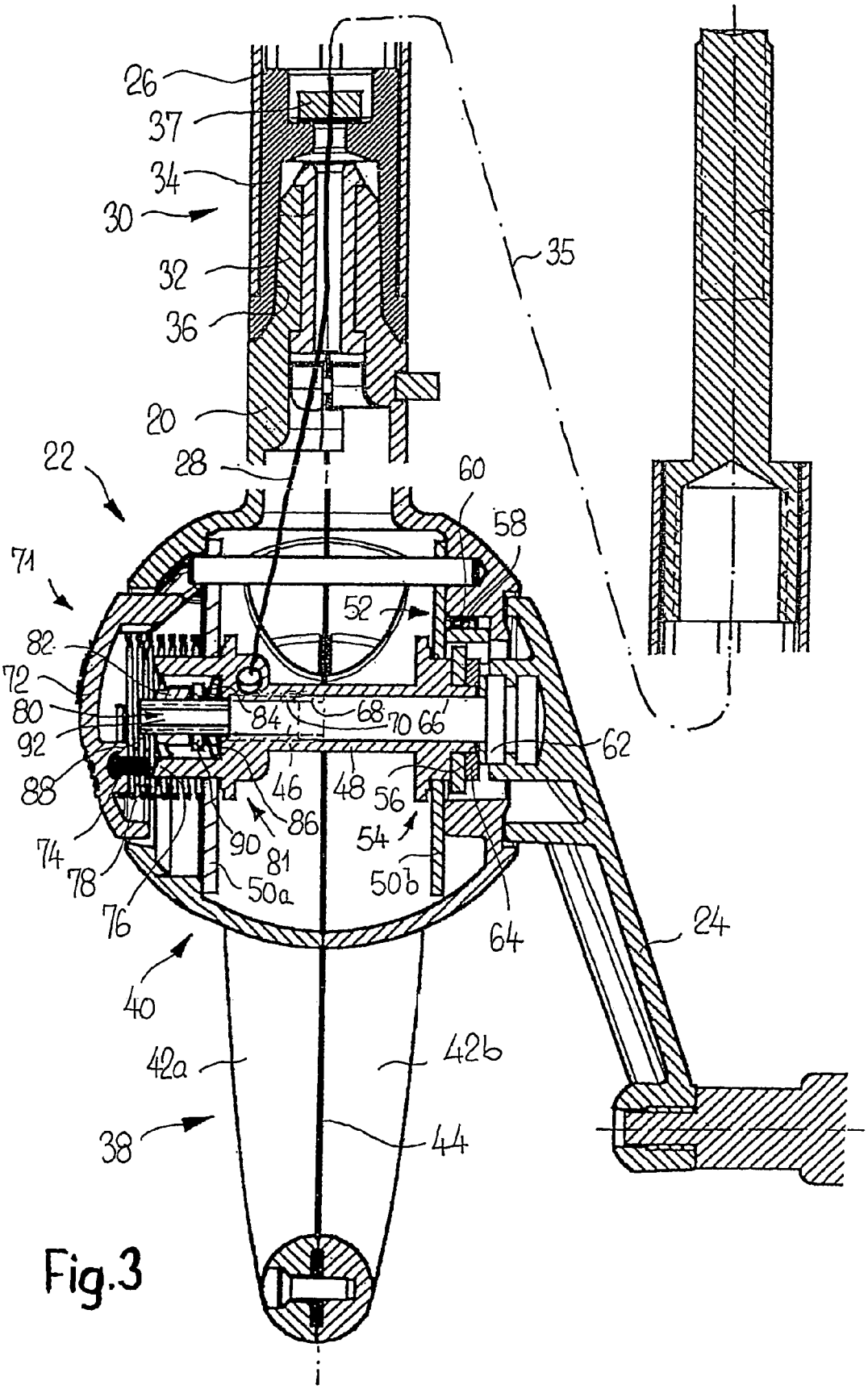
FIG. 3 shows an enlarged vertical section view of the umbrella pole of FIG. 2.
Figure 4:
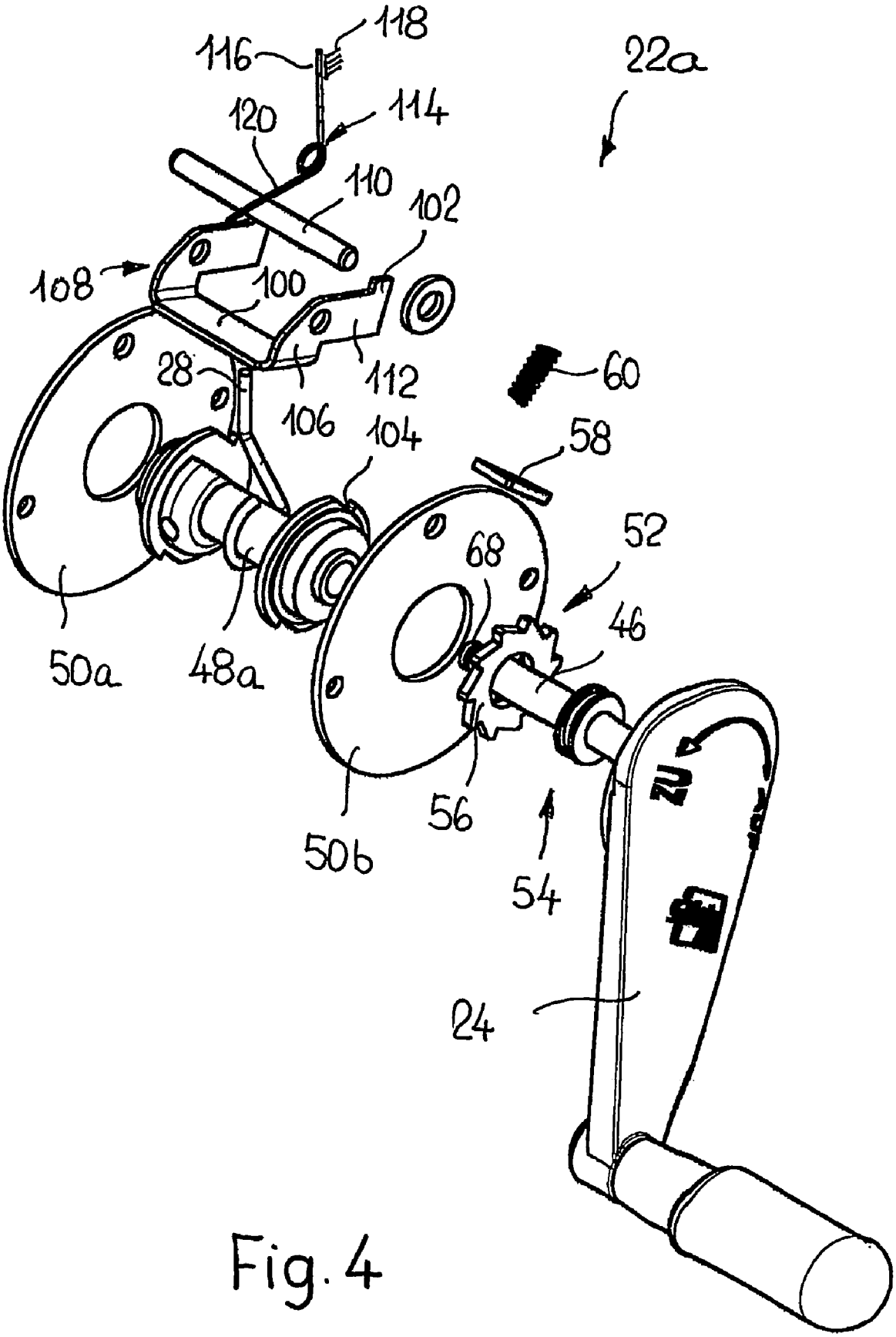
FIG. 4 shows an exploded view of a diagram of a first winch pursuant to the invention.
Figures 5, 6, 7:
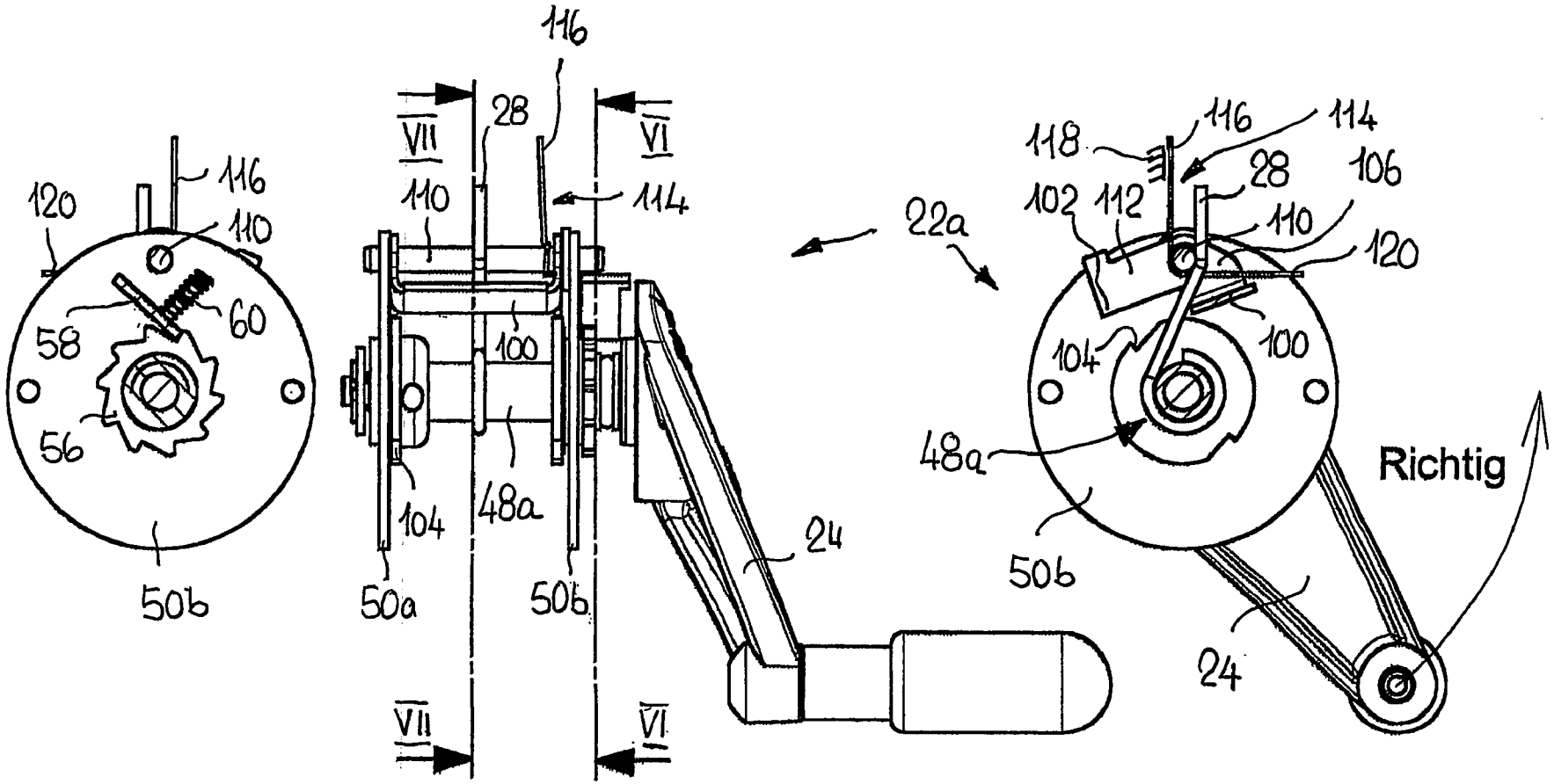
FIG. 5 shows a plan view onto the rope drum of the winch of FIG. 4 in "released position;"
FIG. 6 shows the winch of FIG. 5 in the VI-VI section of FIG. 5.
FIG. 7 shows the winch of FIG. 5 in the VII-VII section of FIG. 5.

FIGS. 1 to 3 show an umbrella 2 in the closed status arranged on an extension arm 4, which is attached to a stand 6 in a telescoping fashion. Such an umbrella is known for example from CH-A-367 290 and 666 166. This known umbrella 2 has an umbrella frame containing a crown 8, which is connected to the extension arm 4 via a ball joint 10. On the crown 8 are provided top rods 12, which are supported by a slide 16 via support rods 14. The slide 16 and the crown 8 are connected to each other via an umbrella pole 18.

This umbrella is equipped with a winch as drive pursuant to EP application 02011893.1. The umbrella pole 18 contains a first lower pole section 20, which is connected to the slide 6, wherein it is inserted in an opening of the slide 16 and secured against sliding out by means of a retaining element 21. On the lower end of the pole section is arranged a winch 22, which is actuated by a manual crank 24. The umbrella pole 18 comprises also a second upper pole section 26, which is connected to the crown 8. If the umbrella is closed pursuant to FIG. 1, the first pole section 20 and the second pole section 26 are separated from each other and only connected by means of a rope 28 of the winch 22. If the umbrella is open, the pole sections 20 and 26 are connected to each other via a coupling device 30, as is illustrated in FIGS. 2 and 3. The coupling device 30 is formed by a profiled pin 32 on one of the pole sections 20, which coacts with a bushing 34 of the other pole section 26, wherein the bushing is equipped with a corresponding counterprofile 36 in order to achieve a torsionally rigid connection between the pole sections 20, 26. The rope 28 is guided substantially coaxially with respect to the center line 35 through the hollow pole sections 20, 26 and is attached on the inside of the bushing 34 of the coupling device 30 by means of a seal 37 or a knot.

The first pole section 20 comprises the winch 22 with the manual crank 24. In addition, the first pole section 20 is equipped with a ring-like handle 38, which extends downward transversely to the axis of the winch 22 and is molded onto the housing 40 of the winch. In this example, the first pole section 20, the housing 40 of the winch 22, and the ring-like handle 38 are configured as one piece and are formed by two molded halves 42*a* and 42*b*, which rest against each other in a vertical center plane 44, which is aligned transversely to the axis of the winch 22.

The winch 22 is formed by the manual crank 24, which is mounted on an axle 46 seated in a rope drum 48. The rope drum, in turn, is seated in bearing plates 50*a*, 50*b* of the housing 40. The rope drum serves for winding and unwinding the rope 28. The winch 22 is equipped with a click-stop device 52 in order to keep the umbrella frame and consequently the umbrella in the open status. This click-stop device is combined with a brake device 54, which enables a controlled closing of the umbrella.

The click-stop device 52 consists of a ratchet 56, which can freely rotate on the rope drum 48 and on which a pawl 58 engages, which is seated in the housing 40 and is prestressed against the ratchet by means of a spring 60. The axle 46 rests against the ratchet 56 by means of a flange 62 and a brake disk 64. The axle 46, which is arranged coaxially in an opening 66 of the rope drum 48, is connected via a threaded joint to said axle and comprises an outside thread 68, which cooperates with an inside thread 70 of the opening 66 of the rope drum.

The operating principle of the winch 22 with the click-stop device 52 and the brake device 54 is as follows:

If the manual crank 24 is rotated clockwise to open up the umbrella, the outside thread 68 of the axle 46 is screwed further into the inside thread 70 of the rope drum 48 that is curbed by the tension of the rope 28, causing the flange 62 of the axle 46 to press the brake disk 64 against the ratchet 56 and fixing it on the rope drum 48. In this way, the manual crank 24 is connected to the rope drum 48 and the rope 28 can be wound, wherein the pawl 58 on the ratchet 56 prevents the coupled rope drum from reversing. If the umbrella is to be closed, the manual crank 24 is moved counterclockwise, thus screwing the axle 46 out of the rope drum 48 through the outside thread 68 and loosening the flange 62 from the status wherein it is pressed against the brake disk 64 in the direction of a slipping clutch. As soon as the brake pressure of the brake disk 64 is less than the tensile force of the rope 28 on the rope drum 48, the action of the click-stop device 52 is interrupted and the rope 28 begins to run off the rope drum 48. If the manual crank 24 is stopped, the tensile force of the rope leads to a continued turning of the rope drum 48 and thus a tightening of the outside thread 68 and the inside thread 70, thereby increasing the brake pressure on the brake disk 64 until the rope drum 48 comes to a standstill. Only a renewed reversal of the manual crank 24 in counterclockwise direction will restart the unwinding of the rope 28 and consequently the closing of the umbrella. In this way is made possible a controlled closing of the umbrella.

For a rapid closure of the umbrella, the winch 22 is also equipped with a freewheel device 71 containing a freewheel button 72, which is arranged on the side of the housing 40 facing away from the manual crank 24. The freewheel button 72 contains a retaining pin 74, which can be moved against a locking profile 76 of the rope drum 48 in opposition to the force of a prestress spring 78. The freewheel device 71 then contains on the side of the axle 46 facing away from the manual crank 24 also an axle extension 80 comprising a blocking device 81, which carries a stop 82 that coacts with the face 86 of the rope drum 48 via a spring 84. The axle extension 80 has a thread 88, which carries the stop 82 designed as a nut. A circlip 90 comprising a radially inward directed latch engages with a groove 92 in the axle extension 80 of the axle in order to prevent an unintended adjustment of the stop 82.

The operating principle of the freewheel device 71 is as follows:

If the freewheel button 72 is actuated, the retaining pin 74 engages with the locking profile 76 of the rope drum 48 and the rope drum 48 is blocked. In this state, the manual crank 24 can be rotated further in counterclockwise direction until the outside thread 68 and the inside thread 70 have been loosened enough so that no frictional connection exists between the brake disk 64 and the ratchet 56. At the same time, the stop 82 presses the spring 84 against the face 86 of the rope drum 48, so that the rope drum 48 and the axle 46 are blocked, and the outside thread 68 and the inside thread 70 can no longer move relative to each other. In this way, the brake disk 64 is prevented from remaining active on the ratchet 56. If now the freewheel button 72 is released, the rope 28 rolls from the rope drum 48 due to the tensile force of the rope 28 and rotates the rope drum 48 and the manual crank attached thereto. The locking of the blocking device 81 is eliminated, and the brake device 54 and the click-stop device 52 are activated again if the manual crank 24 is moved with increased rope tension in clockwise direction, that is, in the opening direction of the umbrella, thus releasing the stop 82 from the face 86 and restarting the clamping action of the brake disk 64.

The winch pursuant to the invention illustrated in FIGS. 4 to 10 is suited for various applications, but particularly in connection with a winch 22 of the above-described kind; in the following description, the reference numbers utilized above are used for identical components, and with respect to the details reference is made to the above description.

FIGS. 4 to 9 show an embodiment of a winch 22*a* pursuant to the invention having a feeler 100 that responds to the direction of entry of the rope on the rope drum 48*a* if the rope 28 is fully unwound and is connected to a locking member 102, which coacts with a stop 104 assigned to the rope drum 48*a* if the rope is wound in the wrong direction and locks the wrong winding direction.

Figures 8, 9:
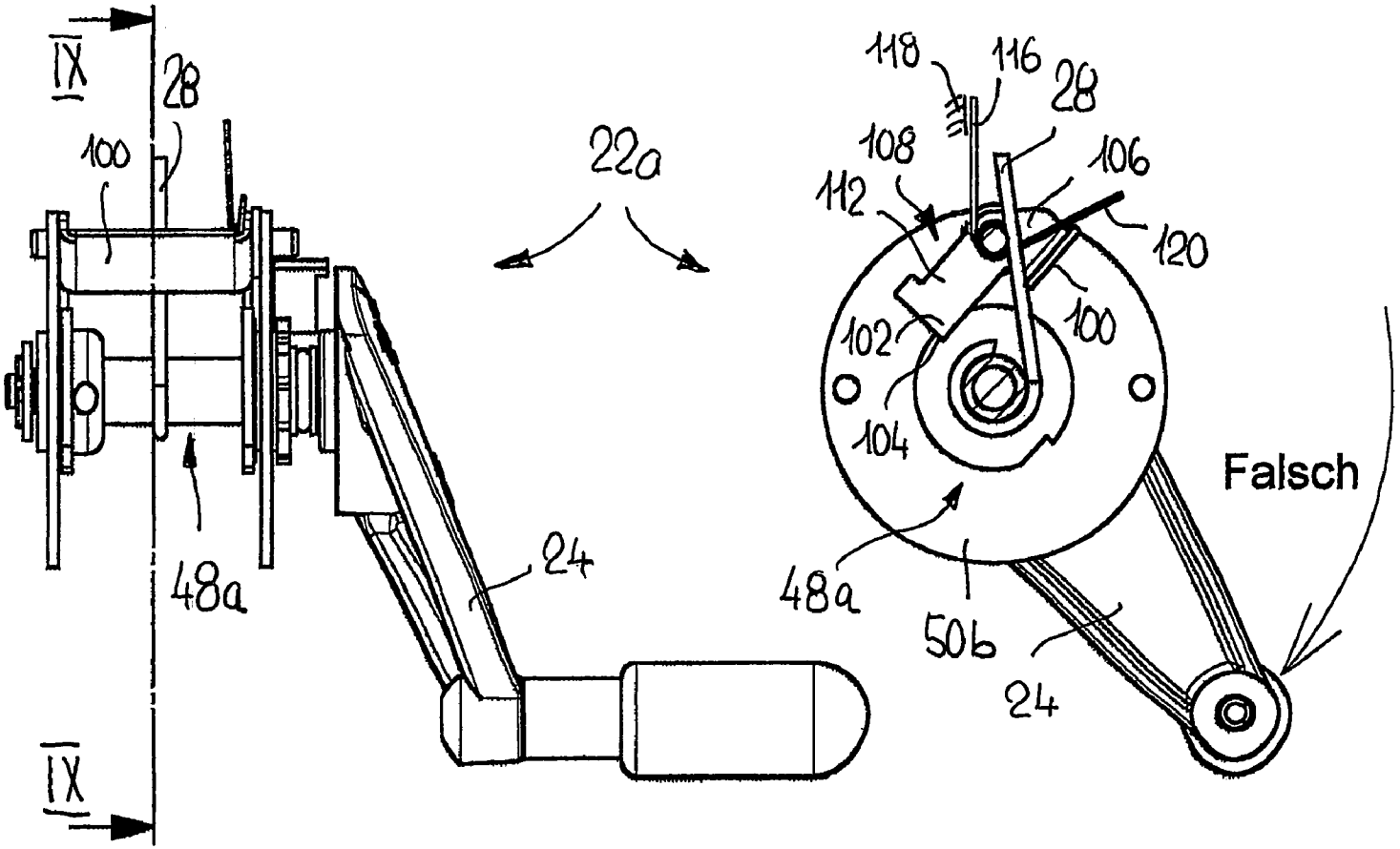
FIG. 8 shows the winch from FIG. 5 in the "locking position"
FIG. 9 shows the winch of FIG. 8 in the IX-IX section of FIG. 8.

The feeler 100 extends across the entire length of the rope drum 48*a* and is mounted on an arm 106 of a two-arm rocker 108, which is pivotably arranged on a pivot pin 110. The pivot pin 110 is mounted on bearing plates 50*a*, 50*b*, which are fixedly arranged on both sides of the rope drum 48. The second arm 112 of the rocker 108 contains the locking member 102, which coacts with the stop 104 that is mounted on the rope drum 48. A spring 114 is mounted on the pivot pin 110, is supported by the housing 118 with a spring arm 116, and prestresses the feeler 100 in the free position with the other spring arm 120. The pivot pin 110 extending across the rope drum 48*a* at the same time acts as a guide for the rope 28, as shown in detail in FIGS. 7 and 9. If the rope is wound in the correct direction ("open" in FIG. 4) pursuant to FIG. 7, the feeler 100 assumes the released position shown in FIG. 7. However, if the winding occurs in the wrong direction ("closed" in FIG. 4), the entering rope 28 lifts the feeler 100 into the locking position, in which the locking member 102 coacts with the stop 104, as shown in FIG. 9. Any further rotation of the crank 24 is then blocked.

Figure 10:
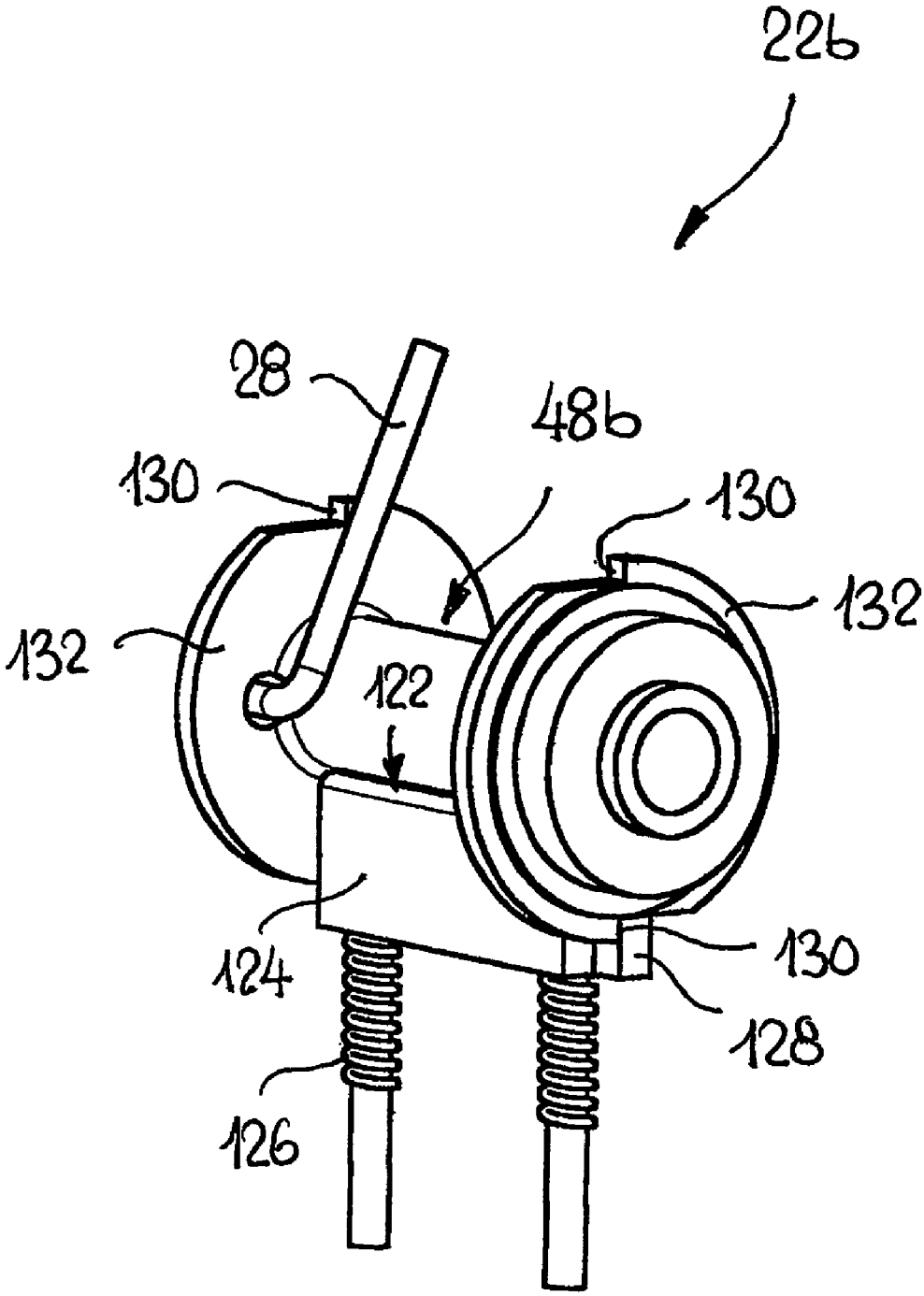
FIG. 10 shows a diagram of a second winch pursuant to the invention.

FIG. 10 shows another embodiment of the winch 22*b* pursuant to the invention, in which a feeler 122 is configured as a slide 124, which can be advanced practically radially against the rope drum 48. Springs 126 prestress the slide 124 against the rope drum 48*b*. The slide 124 is equipped with locking members 128, which coact with stops 130 that are arranged on lateral flanges 132 of the rope drum 48*b*. The arrangement is such that the locking members 128 are advanced against the stops 130 in a wrong winding direction (counterclockwise), thus preventing further rotation of the rope drum 48*b* in the wrong direction of rotation. If the rope drum 48*b*, in contrast, is driven in the correct direction of rotation (clockwise), the locking members 128 are inactive. The winding of the rope 28 on the rope drum 48*b* lifts the feeler 122 further off as the winding operation progresses, which distances the locking members 128 increasingly radially away from the stops 130, thus making them inactive, so that the winch can be rotated freely also in the opposite direction in order to unwind the rope 28 until the feeler 122 detects that the rope 28 has been unwound completely from the rope drum 48*b*.

Figure 13:
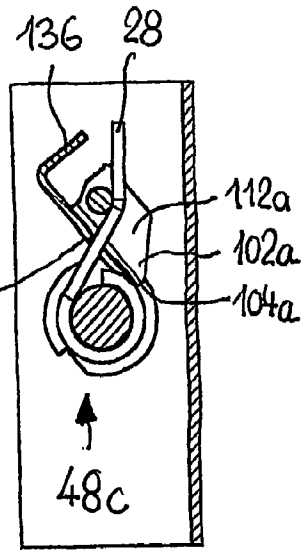
FIG. 13 shows the winch of FIG. 12 in the "locking position".
Figure 12:
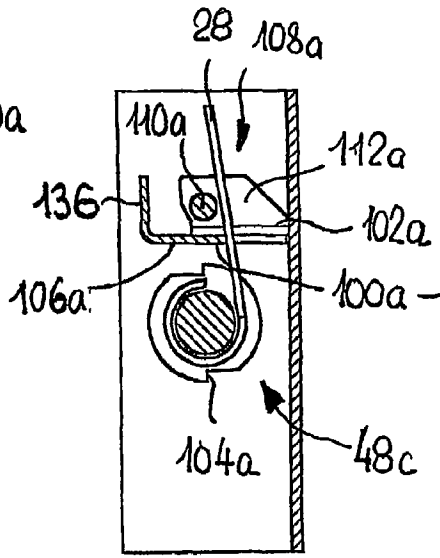
FIG. 12 shows the winch of FIG. 11 in the "released position" in the XI-XI section of FIG. 11.
Figure 11:
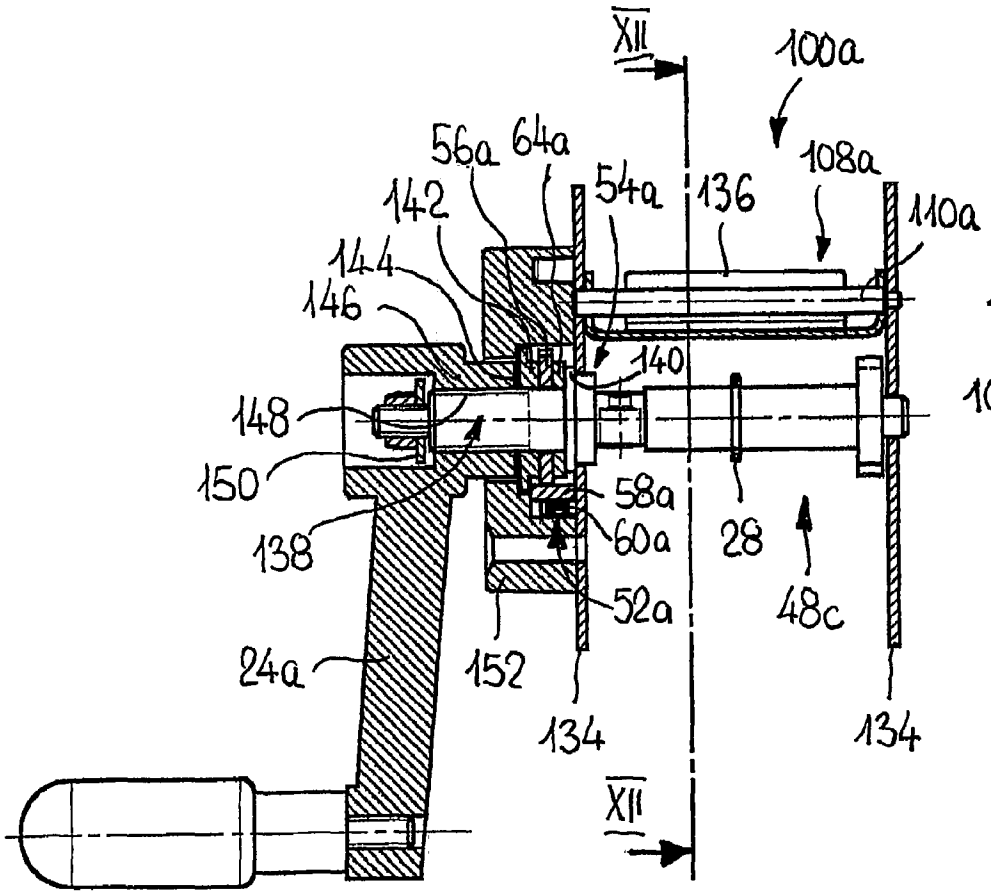
FIG. 11 shows a vertical section view of a third winch pursuant to the invention.

FIGS. 11 to 13 show another embodiment of a winch 22*c* pursuant to the invention, which is equipped with a click-stop device 52*a* and brake device 54*a* combination and also has a feeler 110*a*, which is configured analog to that in FIGS. 4 to 9. If the rope 28 is unwound completely, the feeler 100*a* responds to the direction of entry of the rope onto the rope drum 48*c* and is connected to a locking member 102*a*, which coacts with a stop 104*a* assigned to the rope drum 48*c* if the winding occurs in the wrong direction, which locks the wrong winding direction.

The feeler 100*a* extends across the entire length of the rope drum 48*c* and is fixedly mounted on an arm 106*a* of a two-arm rocker 108*a*, which is pivotably arranged on a pivot pin 110*a*. The pivot pin 110*a* is mounted to housing sides 134, which are fixedly arranged on both sides of the rope drum 48*c*. The second arm 112*a* of the rocker 108*a* contains the locking member 102*a*, which coacts with the stop 104*a* that is mounted on the rope drum 48*c*. Instead of the spring 114 of the example of FIGS. 4 to 9, the rocker 108*a* is provided in this example on a first arm 106*a* with a mass piece 136, which causes the prestressing of the rocker 108*a* in the released position due to the gravity of the mass piece 136. The pivot pin 110*a* extending across the rope drum 48*c* again acts at the same time as a guide for the rope 28, as shown in detail in FIGS. 12 and 13. If the rope is wound in the "correct" direction pursuant to FIG. 12, the feeler 100*a* assumes the "released position" shown in FIG. 12. If winding however occurs in the "wrong" direction, the entering rope 28 swivels the feeler 100*a* into the "locking position," in which the locking member 102*a* coacts with the stop 104*a*, as shown in FIG. 13. Any further rotation of the crank 24*a* is then blocked.

For the purpose of forming the click-stop device 52*a* and brake device 54*a* combination, the rope drum 48*c* contains a shaft end 138 projecting from the housing side 134, wherein said end is equipped with a supporting flange 140 on the housing side. A brake disk 64*a* rests against the supporting flange 140, followed by a ratchet 56*a* and a thrust washer 142, which rests against the face 144 of a threaded sleeve 146 that is screwed onto a threaded section 148 of the shaft end 138. The threaded sleeve 146 forms part of the manual crank 24*a* of the winch 22*c*. A stop 150, which takes on the form of a disk retained by a nut and is arranged on the free end of the shaft end, prevents undesired unscrewing of the manual crank 24*a* from the shaft end 138. A pawl 58*a*, which is prestressed by means of a spring 60*a* and is fixedly mounted in a housing 152, coacts with the ratchet 56*a*.

The mode of operation of the winch 22*c* is as follows:

For the purpose of winding the rope 28, the manual crank 24*a* is moved clockwise, which causes the manual crank 24*a* to screw the threaded sleeve 146 onto the threaded section 148 and consequently presses with its face 144 the thrust washer 142 against the ratchet 56*a* until said face is locked between the brake disk 64*a* and the thrust washer 142. The ratchet 56*a* and the engaging pawl 58*a* prevent the winch from reversing and hence unwinding of the rope 28. In order to unwind the rope 28, the manual crank 24 is rotated counterclockwise, wherein due to the locking effect of the click-stop device 52*a* the threaded sleeve 146 is screwed out of the threaded section 148 and consequently the pressing force on the thrust washer 142 is reduced, thus decreasing the locking status of the ratchet 56*a* and allowing the rope drum 48*c* to rotate likewise counterclockwise due to the tensile force of the rope 28 and releasing the rope 28. However, this effects in turn a screwing in of the threaded sleeve 146 onto the threaded section 148 and leads thereupon to a renewed clamping of the ratchet and braking of the unwinding rope. Through a controlled rotation of the manual crank 24*a* in counterclockwise direction can thus be achieved likewise a curbed, that is, controlled, unwinding of the rope 28 from the rope drum 48*c*.

The winch pursuant to FIGS. 11 to 13 is preferably suited for umbrellas pursuant to WO97/04682 and WO01/52686.

LEGEND

2 Umbrella
2*a* Umbrella
4 Extension Arm
6 Stand
8 Crown
10 Pivot Joint
12 Top Rods
14 Support Rods
16 Slide
18 Umbrella Pole
20 First Pole Section
20*a* First Pole Section
21 Retaining element
22 Winch
22*a* Winch
22*b* Winch
22*c* Winch
24 Manual crank
24*a* Manual crank
26 Second Pole Section
28 Rope
30 Coupling Device
32 Pin

34 Bushing
35 Center Line of 18
36 Counterprofile
37 Seal
38 Ring-Like Handle
40 Housing
42*a* Molded Half
42*b* Molded Half
44 Center Plane
46 Axle
48 Rope Drum
48*a* Rope Drum
48*b* Rope Drum
48*c* Rope Drum
50*a* Bearing Plates
50*b* Bearing Plates
52 Click-stop device
52*a* Click-stop device
54 Brake Device
54*a* Brake Device
56 Ratchet
56*a* Ratchet
58 Pawl
58*a* Pawl
60 Spring
60*a* Spring
62 Flange
64 Brake Disk
64*a* Brake Disk
66 Opening
68 Outside Thread
70 Inside Thread
71 Freewheel Device
72 Freewheel Button
74 Retaining Pin
76 Locking Profile
78 Prestress Spring
80 Axle Extension
81 Blocking Device
82 Stop
84 Spring
86 Face of 48
88 Thread
90 Circlip
92 Groove
100 Feeler
100*a* Feeler
102 Locking Member
102*a* Locking Member
104 Stop
104*a* Stop
106 Arm
106*a* Arm
108 Rocker
108*a* Rocker
110 Pivot Pin
110*a* Pivot Pin
112 Arm
112*a* Arm
114 Spring
116 Spring Arm
118 Housing
120 Spring Arm
122 Feeler
124 Slide
126 Spring
128 Locking Element
130 Stop
132 Flange
134 Housing Side
136 Mass Piece
138 Shaft End
140 Supporting Flange
142 Thrust Washer
146 Threaded Sleeve
148 Threaded Section
150 Stop
152 Housing

The invention claimed is:

1. A winch for driving an umbrella, having a rope drum driven by a manual crank for winding up a rope, wherein a feeler is provided that responds to the direction of entry of the rope if the rope is fully unwound or if the rope is wound onto the rope drum, said feeler being connected to a locking member that coacts with at least one stop if the winding occurs in the wrong direction, said stop being arranged at the rope drum and locking the wrong winding direction.

2. The winch of claim 1, wherein the feeler is prestressed in the locking position.

3. The winch of claim 2, wherein the feeler is fixedly mounted over the entire length of the rope drum.

4. The winch of claim 2, having a releasable click-stop device and a releasable brake device, which can be intercombined and can be operated by means of the manual crank.

5. The winch of claim 1, wherein the feeler is prestressed in the released position.

6. The winch of claim 5, wherein the feeler is fixedly mounted over the entire length of the rope drum.

7. The winch of claim 5, having a releasable click-stop device and a releasable brake device, which can be intercombined and can be operated by means of the manual crank.

8. The winch of claim 1, wherein the feeler is fixedly mounted over the entire length of the rope drum.

9. The winch of claim 8, wherein the feeler is arranged on both sides on an arm, respectively, of a two-arm rocker, which is pivotably mounted around a pivot pin, which is arranged parallel to the axis of the rope drum and at a radial distance thereto, wherein the locking member is arranged respectively on the other arm of the rocker.

10. The winch of claim 9, having a guide rod extending over the rope drum for entry of the rope.

11. The winch of claim 10, having a releasable click-stop device and a releasable brake device, which can be intercombined and can be operated by means of the manual crank.

12. The winch of claim 9, having a releasable click-stop device and a releasable brake device, which can be intercombined and can be operated by means of the manual crank.

13. The winch of claim 8, wherein the feeler is configured as a slide that is prestressed against the rope drum and on which the locking member is arranged, which runs against the stop in the case of a wrong direction of rotation of the rope drum and can be lifted out of the locked area of the stop in the case of a correct direction of rotation.

14. The winch of claim 13, having a releasable click-stop device and a releasable brake device, which can be intercombined and can be operated by means of the manual crank.

15. The winch of claim 8, having a releasable click-stop device and a releasable brake device, which can be intercombined and can be operated by means of the manual crank.

16. The winch of claim 1, having a releasable click-stop device and a releasable brake device, which can be intercombined and can be operated by means of the manual crank.

17. The winch of claim 16, wherein the manual crank is connected via a threaded joint to the rope drum, which is mounted in a housing of the winch and can be latched by means of the click-stop device to a ratchet that is rotatable on the rope drum and a pawl located on a housing side; the ratchet is connected via a brake disk in the axial direction to the manual crank such that during the opening motion of the manual crank the brake disk is pressed against the ratchet by the threaded joint and blocks said ratchet, and that during the counterclockwise closing motion of the manual crank, the pressure against the brake disk is released in the sense of a slipping clutch, so that the rope can roll off the rope drum.

18. The winch of claim 17, wherein the manual crank is attached to an axle, which is guided coaxially through an opening of the rope drum and screwed together with an inside thread of the rope drum via an outside thread.

19. The winch of claim 18, wherein a freewheel device comprises a freewheel button that can be operated from the outside of the housing and works together with the click-stop device, and wherein the freewheel device includes, a retaining pin that can retract against a locking profile of the rope drum in order to block the rope drum until the brake device becomes inactive as the closing motion of the manual crank progresses.

20. The winch of claim 17, wherein a freewheel device comprises a freewheel button that can be operated from the outside of the housing and works together with the click-stop device, and wherein the freewheel device includes a retaining pin that can retract against a locking profile of the rope drum in order to block the rope drum until the brake device becomes inactive as the closing motion of the manual crank progresses.

21. The winch of claim 16 wherein a freewheel device comprises a freewheel button that can be operated from the outside of the housing and works together with the click-stop device, and wherein the freewheel device includes a retaining pin that can retract against a locking profile of the rope drum in order to block the rope drum until the brake device becomes inactive as the closing motion of the manual crank progresses.

22. The winch of claim 21, wherein the freewheel device has a stop, against which the manual crank rests in a blocking state as a closing motion progresses and if the brake device is released.

23. The winch of claim 22, wherein the stop is arranged on an axle extension of the axle and coacts with the face of the rope drum via a spring.

* * * * *